US008534991B2

(12) United States Patent
Topol

(10) Patent No.: US 8,534,991 B2
(45) Date of Patent: Sep. 17, 2013

(54) COMPRESSOR WITH ASYMMETRIC STATOR AND ACOUSTIC CUTOFF

(75) Inventor: David A. Topol, West Hartford, CT (US)

(73) Assignee: United Technologies Corporation, Hartford, CT (US)

( * ) Notice: Subject to any disclaimer, the term of this patent is extended or adjusted under 35 U.S.C. 154(b) by 1012 days.

(21) Appl. No.: 12/622,458

(22) Filed: Nov. 20, 2009

(65) Prior Publication Data

US 2011/0123342 A1 May 26, 2011

(51) Int. Cl.
*F01D 9/04* (2006.01)

(52) U.S. Cl.
USPC ..... 415/119; 415/195

(58) Field of Classification Search
USPC ..... 415/119, 191, 195, 211.2
See application file for complete search history.

(56) References Cited

U.S. PATENT DOCUMENTS

| | | | | |
|---|---|---|---|---|
| 1,534,721 | A * | 4/1925 | Lasche | 415/195 |
| 3,006,603 | A * | 10/1961 | Caruso et al. | 415/195 |
| 3,990,810 | A | 11/1976 | Amos et al. | |
| 4,231,703 | A | 11/1980 | Weiler | |
| 4,253,800 | A * | 3/1981 | Segawa et al. | 416/203 |
| 4,795,307 | A | 1/1989 | Liebl | |
| 5,211,537 | A | 5/1993 | Langston et al. | |
| 5,308,226 | A | 5/1994 | Venkatasubbu et al. | |
| 5,357,748 | A | 10/1994 | Khalid | |
| 5,462,403 | A | 10/1995 | Pannone | |
| 5,593,275 | A | 1/1997 | Venkatasubbu et al. | |
| 6,439,838 | B1 * | 8/2002 | Crall et al. | 415/119 |
| 6,481,960 | B2 | 11/2002 | Bowen | |
| 6,969,239 | B2 | 11/2005 | Grant et al. | |
| 7,097,420 | B2 * | 8/2006 | Cormier et al. | 415/119 |
| 7,594,794 | B2 | 9/2009 | Merry et al. | |
| 7,743,497 | B2 * | 6/2010 | Gautreau et al. | 29/888.021 |
| 7,891,943 | B2 * | 2/2011 | Tsuchiya et al. | 415/195 |
| 8,277,166 | B2 * | 10/2012 | Tecza et al. | 415/1 |
| 2007/0079506 | A1 * | 4/2007 | Gautreau et al. | 29/888.021 |

FOREIGN PATENT DOCUMENTS

WO WO2007/063768 * 6/2007

OTHER PUBLICATIONS

Aeruacoustic Analysis of Turbofan Noise Generation, Harold D. Meyer and Edmane Envia, NASA Contract Report 4715, Mar. 1996.
Axial Flow Compressor Noise Studies, J.M. Tyler and T.G. Sofrin, Pratt & Whitney Div., United Aircraft Corp., SAE Transactions Reprint, Jan. 1, 1962.

* cited by examiner

*Primary Examiner* — Edward Look
*Assistant Examiner* — Liam McDowell
(74) *Attorney, Agent, or Firm* — Carlson, Gaskey & Olds, PC

(57) ABSTRACT

A method of manufacturing a compressor section includes the steps of defining a compressor section having a number of blades, and having one or more stator sections, each with numbers of vanes. Each stator section has at least two sections wherein the spacing between the vanes in a first of the sections is not equal to a spacing between the vanes in a second of the sections. The number of blades, and the number of vanes where all of the sections are selected to achieve acoustic cutoff.

10 Claims, 2 Drawing Sheets

COMPRESSOR WITH ASYMMETRIC STATOR AND ACOUSTIC CUTOFF

BACKGROUND OF THE INVENTION

This application relates to a compressor for a gas turbine engine, wherein the stator vanes are asymmetric, and wherein acoustic cutoff is achieved.

Gas turbine engines typically include a compressor which compresses air and delivers it into a combustion chamber. The compressed air is mixed with fuel and combusted in the combustion section. Products of this combustion pass downstream over turbine rotors.

The compressor is typically provided with rotating blades, and stator vanes adjacent to the blades. The stator vanes control the flow of the air to the compressor rotor.

A concept known as "cutoff" is utilized in the design of compressors, and relates the number of vanes in the stator to the number of blades in the rotor. The goal of "cutoff" is to ensure that generated noise decays in a compressor duct, instead of propagating to a far field. Compressors which have achieved cutoff in the past have equally spaced stator vanes across the entire circumference of the stator section, and equally spaced rotor blades.

Recently, asymmetric stator vanes have been developed, which have unequally spaced stator vanes on two halves of a circumference. The spacing of the stator vanes in a lower half is unequal from the spacing of the vanes in an upper half. The purpose of the unequal spacing is structural.

SUMMARY OF THE INVENTION

A method of manufacturing a compressor section includes the steps of defining a compressor section having a number of blades, and having at least one stator section with a number of vanes. Each stator section has at least two sections wherein the spacing between the vanes in a first of the sections is not equal to the spacing between the vanes in a second of the sections. The number of blades, and the number of vanes in all of the sections are selected to achieve acoustic cutoff.

A compressor section designed and manufactured by the above method is also disclosed and claimed.

These and other features of the present invention can be best understood from the following specification and drawings, the following of which is a brief description.

DETAILED DESCRIPTION OF THE PREFERRED EMBODIMENT

Figure 1:
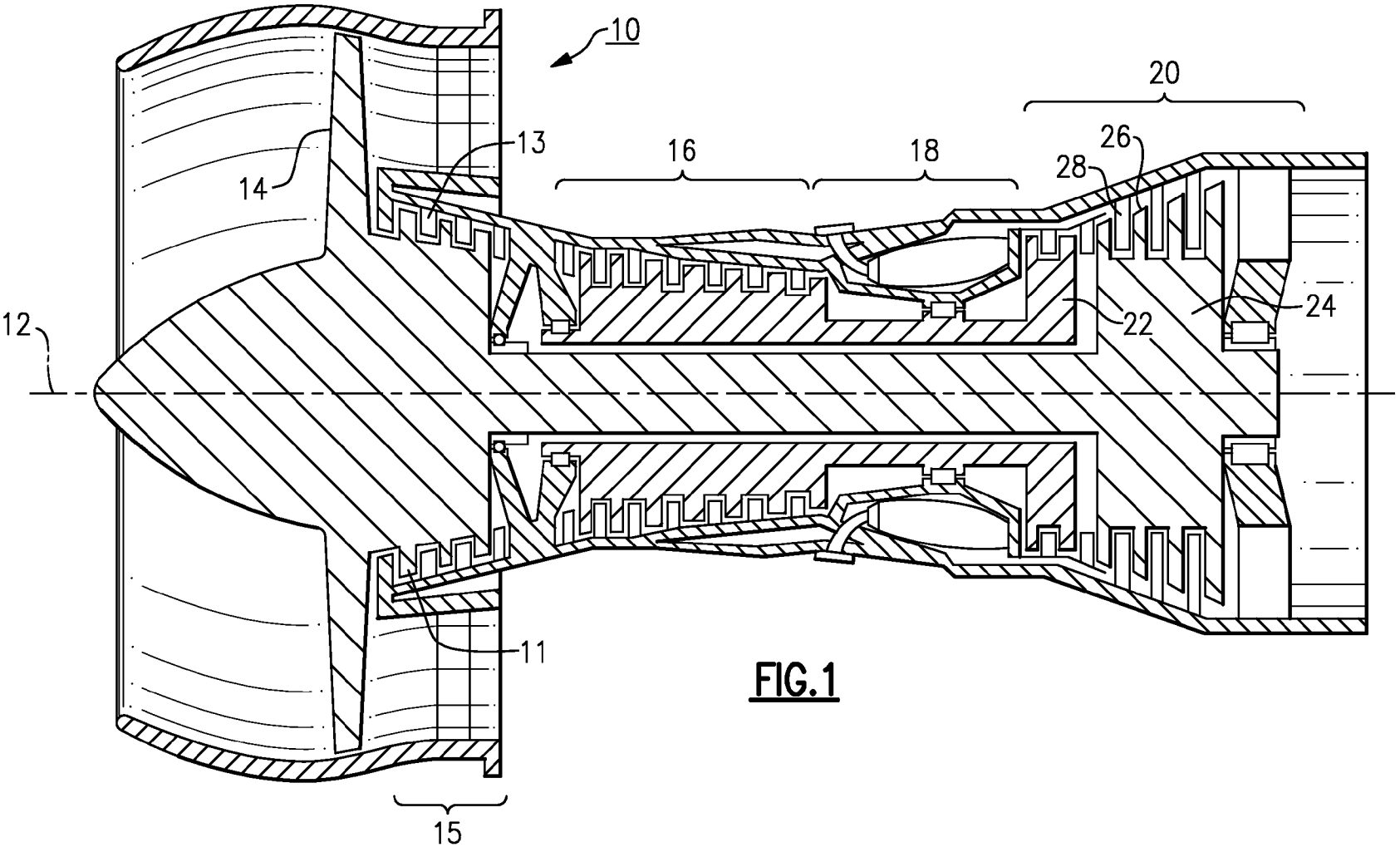
FIG. 1 schematically shows a gas turbine engine.

A gas turbine engine 10, such as a turbofan gas turbine engine, circumferentially disposed about an engine centerline, or axial centerline axis 12 is shown in FIG. 1. The engine 10 includes a fan 14, compressor sections 15 and 16, a combustion section 18 and a turbine 20. As is well known in the art, air compressed in the compressor 15/16 is mixed with fuel and burned in the combustion section 18 and expanded in turbine 20. In addition, the compressor section includes stator sections 13 having a plurality of vanes, and rotor blades 11. The blades and vanes are shown in the low pressure compressor 15, however, similar structure is found in the high pressure compressor section 16. The vanes may be static vanes or variable vanes. The turbine 20 includes rotors 22 and 24, which rotate in response to the expansion. The turbine 20 comprises alternating rows of rotary airfoils or blades 26 and static airfoils or vanes 28. It should be understood that this view is included simply to provide a basic understanding of the sections in a gas turbine engine, and not to limit the invention. This invention extends to all types of turbine engines for all types of applications.

Figure 2:
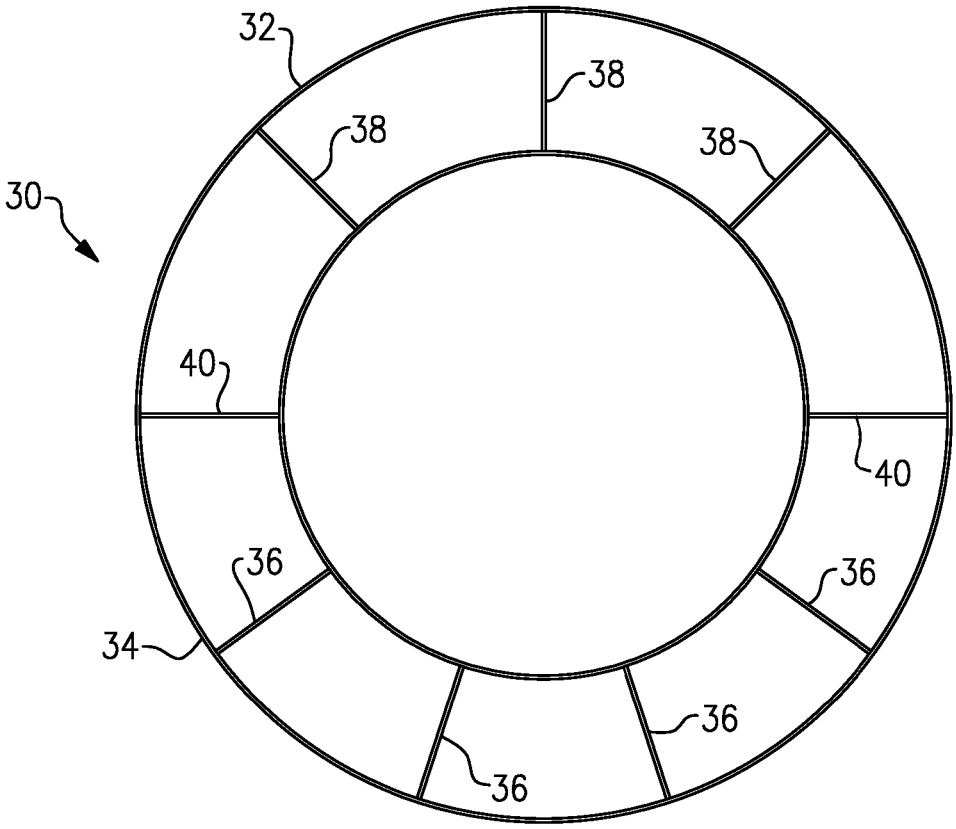
FIG. 2 schematically shows a compressor stator for the FIG. 1 gas turbine engine.

A compressor stator section 30, such as may be employed in a gas turbine engine, is illustrated in FIG. 2. As shown, there is an upper half of the circumference 32 and a lower half 34. Vanes 40 are positioned at a dividing point between the two sections 32 and 34. The vanes 36 in the lower section are spaced by a first pitch, while the vanes 38 in the upper section are spaced by a second, greater pitch. As can be appreciated, there are more vanes on the bottom half 34 than in the top half 32 in the illustrated arrangement.

While FIG. 2 shows a relatively small number of vanes, it should be understood that typically greater numbers of vanes are included. A sample calculation is provided below, however, the sample calculation is simply one example, and other numbers of blades could come within the scope of this invention.

One way to achieve cutoff with a compressor section having all blades equally spaced, and all stator vanes equally spaced. A formula exists that relates the number of blades, along with the number of vanes with defined when cutoff would occur. That formula is:

$$\xi = \left| \frac{nBM_t}{mM^*_{m\mu}\sqrt{1 - M_x^2}} \right| < 1 \qquad \text{Equation 1}$$

where $$m = nB - kV \qquad \text{Equation 2}$$

and $\xi$=cutoff ratio m=nB−kV=circumferential mode order n=Blade passing frequency harmonic order (any integer from 1 to infinity)

B=Number of compressor rotor blades k=Vane passing frequency harmonic order (any integer from −infinity to infinity)

V=Number of compressor vanes upstream and/or downstream of the compressor rotor $$M_t = \text{Local tip rotational mach number} = \frac{\Omega r}{c_0}$$

$\Omega$=Rotor rotational speed (rad/sec)

r=Local tip duct radius $c_0$=Local speed of sound $M_x$=Mean local axial Mach number in the duct $$M^*_{m\mu} = \frac{\kappa_{m\mu}}{m} = \text{Cutoff Mach number.}$$

This can be shown, such as by Equation 7.3.4 in the cited Tyler/Sofrin SAE article.

$\kappa_{m\mu}$=Mode Eigenvalue for a given (m, $\mu$) mode normalized by r. This can be shown such as from equation 4.7 in the cited Meyer/Envia NASA article.

μ=Radial mode order (integer from 0 to infinity) (set=0 for the purposes of this calculation)

It was originally thought that such cutoff could only occur in a compressor wherein the stator vanes were all equally spaced around the circumference.

However, Applicant has developed a method of identifying parameters to achieve cutoff in a compressor wherein the stator vanes are not equally spaced. In particular, in a stator section such as shown in FIG. 2, cutoff can still be ensured if Equation 1 is met, and wherein m now equals:

$$m=\text{minimum}|m_1 \& m_2| \quad \text{Equation 3}$$

where $$m_1=nB-2kV_1 \quad \text{Equation 4}$$

and $$m_2=nB-2kV_2 \quad \text{Equation 5}$$

One calculates a new $m_1$ and a new $m_2$ and then takes the minimum absolute value of $m_1$ and $m_2$ and utilizes that in Equation 1. Notably, the $m_1$ and $m_2$ include a factor of 2× the number of vanes in each half, to account for the fact that the vanes are only across half the circumference.

If Equation 1 is run with this new calculation, then a compressor section designed accordingly should achieve cutoff. While two sections are shown for the stator section, it is possible that greater numbers of sections can also be utilized, each having unequal numbers of vanes. In designing such a compressor, it may be that the value 2 found in Equations 4 and 5 be increased to equal the number of sections.

A sample calculation is shown below:

Set:

The blade count, B=28

Vane count upstream of the blade V=61 vanes (where $V_1$=30 vanes on one half, $V_2$=31 vanes on the other half)

Vane count downstream of the blade, V=61 vanes (where $V_1$=30 vanes on one half, $V_2$=31 vanes on the other half) (The vane counts upstream and downstream of the vane do not have to be equal, but are set equal for the purposes of this example).

$M_x$=axial Mach number=0.5

$M_t$=0.8 (local tip rotational Mach number)

For blade passing frequency, n=1

Thus for the upstream vane count: Use the smallest value of $|m_1|$ and the smallest value of $|m_2|$ to determine cutoff.

m=nB−kV so setting k=1 gives the smallest value of $|m_1|$ and also gives the smallest value of $|m_2|$ $|m_1|=|1*28-2*1*30|=32$ $|m_2|=|1*28-2*1*31|=34$ m=minimum (32, 34)=32

For a hub/tip ratio of 0.5, and μ=0, $\kappa_{m\mu}$=34.59, $$M^*_{m\mu} = \frac{\kappa_{m\mu}}{|m|} = 1.08.$$

$$\xi = \left|\frac{1*28*0.8}{34.59\sqrt{1-0.5^2}}\right| = 0.75 < 1$$

Repeating this calculation for the downstream vane count gives the same results. So this stage of the LPC is cutoff.

As can be appreciated, the factor of "2" as found in calculating the $m_1$ and $m_2$ value is because there are two sections in the disclosed example. If there were three or more sections, that value would increase, as mentioned above.

One can appreciate also that the minimum absolute value of the $m_1$ and $m_2$ quantities will be found in the section having the fewest number of blades given a unit of circumferential extent. Stated another way, if all of the sections have an equal circumferential extent, would be the section with the minimum number of blades that would be used to do the calculations to insure cutoff is achieved. However, should there be unequal circumferential extents, each of the quantities would be scaled accordingly.

The above formulations and examples assume generally axial flow through the compressor. In fact, it may often be the case that there will be some swirl within the air. While it is likely true the above simplified calculations and formulations would still be accurate even for a compressor having swirl, another formula could be utilized wherein the following formula replaces Equation 1:

$$\xi = \left|\frac{nBM_t - mM_s}{mM^*_{m\mu}\sqrt{1-M_x^2}}\right| < 1 \quad \text{Equation 6}$$

Generally, as the formula shows, the $M_s$ component acts to modify the rotational speed of the mode by the swirl Mach number of the flow. $M_s$ is a local swirl flow mach number in between two rows of vanes and/or blades, with positive being defined in the direction of rotor rotation. The $M_s$ component can be calculated by taking two known quantities, the swirl velocity, and dividing it by the $c_0$, the local speed of sound. The swirl velocity is a quantity which would be known to a worker of ordinary skill in the art, having a particular compressor design.

All of the several variables would be quantities that a worker of ordinary skill in the art would be able to calculate given a particular compressor design.

In sum, a compressor section is disclosed which achieves cutoff even with an asymmetric stator vane section. Thus, with the inventive method, a compressor section can be designed and utilized wherein the structural benefits that may be afforded by asymmetric stators can be achieved, while still achieving the acoustic cutoff benefits which are becoming of increasing importance.

While the disclosed compressor has only two sections, as mentioned above, there could be more than two sections. Further, while the disclosed stator section has its two subsections at top and bottom, other orientations of the two distinct sections could be utilized.

Although an embodiment of this disclosure has been disclosed, a worker of ordinary skill in this art would recognize that certain modifications would come within the scope of the disclosure. For that reason, the following claims should be studied to determine the true scope and content of this disclosure.

What is claimed is:

1. A method of manufacturing a compressor section comprising the steps of:

defining a compressor section having a first number of blades, and at least one stator section having a number of vanes, with each stator section having at least two sections wherein a spacing between the vanes in a first of the sections is not equal to a spacing between the vanes in a second of the sections;

selecting the number of blades, and the number of vanes in at least one of the sections to achieve cutoff; and a minimum absolute value for a quantity m is utilized to calculate whether the compressor will achieve cutoff, and wherein m=nB−2 kV, wherein V is equal to the number of vanes in the one of the two subsections, n is the blade passing frequency harmonic, which is an integer, B is the number of blades, and k is a vane passing frequency harmonic order, which is an integer.

2. The method as set forth in claim 1, wherein a calculation is performed that assumes that air flow through the compressor will be generally axial.

3. The method as set forth in claim 2, wherein the following formula is utilized to determine if the compressor will achieve cutoff:

$$\xi = \left| \frac{nBM_t}{mM^*_{m\mu}\sqrt{1 - M_x^2}} \right| < 1$$

ξ=cutoff ratio n=Blade passing frequency harmonic order (any integer from 1 to infinity)

B=Number of compressor rotor blades k=Vane passing frequency harmonic order (any integer from −infinity to infinity)

V=Number of compressor vanes upstream and/or downstream of the compressor rotor $$M_t = \text{Local tip rotational Mach number} = \frac{\Omega r}{c_0}$$

Ω=Rotor rotational speed (rad/sec)

r=Local tip duct radius $c_0$=Local speed of sound $M_x$=Mean local axial Mach number in the duct $$M^*_{m\mu} = \frac{\kappa_{m\mu}}{m} = \text{Cutoff Mach number}$$

$\kappa_{m\mu}$=Mode Eigenvalue for a given (m, μ) mode normalized by r

μ=Radial mode order (integer from 0 to infinity) (set=0 for the purposes of this calculation).

4. The method as set forth in claim 1, wherein a determination is made that assumes the effect of swirl on air flow through the compressor.

5. The method as set forth in claim 4, wherein the following formula is utilized to determine if the compressor will achieve cutoff:

$$\xi = \left| \frac{nBM_t - mM_s}{mM^*_{m\mu}\sqrt{1 - M_x^2}} \right| < 1$$

ξ=cutoff ratio n=Blade passing frequency harmonic order (any integer from 1 to infinity)

B=Number of compressor rotor blades k=Vane passing frequency harmonic order (any integer from −infinity to infinity)

V=Number of compressor vanes upstream and/or downstream of the compressor rotor $$M_t = \text{Local tip rotational Mach number} = \frac{\Omega r}{c_0}$$

Ω=Rotor rotational speed (rad/sec)

r=Local tip duct radius $c_0$=Local speed of sound $M_s$=is a local swirl flow Mach number in between two rows of vanes and/or blades, and positive being defined in the direction of rotor rotation, and wherein the $M_s$ component is calculated by taking the swirl velocity and dividing it by the $c_0$ value $M_x$=Mean local axial Mach number in the duct $$M^*_{m\mu} = \frac{\kappa_{m\mu}}{m} = \text{Cutoff Mach number}$$

$\kappa_{m\mu}$=Mode Eigenvalue for a given (m, μ) mode normalized by r

μ=Radial mode order (integer from 0 to infinity) (set =0 for the purposes of this calculation).

6. A compressor comprising:

a rotor having a plurality of blades;

at least one stator section having a plurality of vanes, with there being at least two subsections to each stator section, and a spacing between said vanes in a first of said subsections is unequal to a spacing between vanes in a second of said subsections, and the number of vanes being selected in combination with the number of blades in the rotor to achieve cutoff;

a minimum absolute value for a quantity m is utilized to calculate whether the compressor will achieve cutoff, and wherein m=nB−2 kV, wherein V is equal to the number of vanes in the one of the two subsections, n is the blade passing frequency harmonic, which is an integer, B is the number of blades, and k is a vane passing frequency harmonic order, which is an integer.

7. The compressor as set forth in claim 6, wherein a calculation is performed to ensure cut-off is achieved that assumes that air flow through the compressor will be generally axial.

8. The compressor as set forth in claim 7, wherein the following formula is met to ensure the compressor will achieve cutoff:

$$\xi = \left| \frac{nBM_t}{mM^*_{m\mu}\sqrt{1 - M_x^2}} \right| < 1$$

ξ=cutoff ratio n=Blade passing frequency harmonic order (any integer from 1 to infinity)

B=Number of compressor rotor blades k=Vane passing frequency harmonic order (any integer from −infinity to infinity)

V=Number of compressor vanes upstream and/or downstream of the compressor rotor $$M_t = \text{Local tip rotational Mach number} = \frac{\Omega r}{c_0}$$

$\Omega$=Rotor rotational speed (rad/sec)

r=Local tip duct radius $c_0$=Local speed of sound $M_x$=Mean local axial Mach number in the duct $$M^*_{m\mu} = \frac{\kappa_{m\mu}}{m} = \text{Cutoff Mach number}$$

$\kappa_{m\mu}$=Mode Eigenvalue for a given (m, μ) mode normalized by r

μ=Radial mode order (integer from 0 to infinity) (set=0 for the purposes of this calculation).

9. The compressor as set forth in claim 6, wherein a determination is made that assumes the effect of swirl on air flow through the compressor.

10. The compressor as set forth in claim 9, wherein the following formula is utilized to determine if the compressor will achieve cutoff:

$$\xi = \left| \frac{nBM_t - mM_s}{mM^*_{m\mu}\sqrt{1 - M_x^2}} \right| < 1$$

ξ=cutoff ratio n=Blade passing frequency harmonic order (any integer from 1 to infinity)

B=Number of compressor rotor blades k=Vane passing frequency harmonic order (any integer from −infinity to infinity)

V=Number of compressor vanes upstream and/or downstream of the compressor rotor $$M_t = \text{Local tip rotational Mach number} = \frac{\Omega r}{c_0}$$

$\Omega$=Rotor rotational speed (rad/sec)

r=Local tip duct radius $c_0$=Local speed of sound $M_s$=is a local swirl flow Mach number in between two rows of vanes and/or blades, and positive being defined in the direction of rotor rotation, and wherein the $M_s$ component is calculated by taking the swirl velocity and dividing it by the $c_0$ value $M_x$=Mean local axial Mach number in the duct $$M^*_{m\mu} = \frac{\kappa_{m\mu}}{m} = \text{Cutoff Mach number}$$

$\kappa_{m\mu}$=Mode Eigenvalue for a given (m, μ) mode normalized by r

μ=Radial mode order (integer from 0 to infinity) (set=0 for the purposes of this calculation).

* * * * *